US006945249B2

(12) United States Patent
Griesbach, III et al.

(10) Patent No.: US 6,945,249 B2
(45) **Date of Patent: *Sep. 20, 2005**

(54) EASY GRIPPING FACE MASK

(75) Inventors: Henry L. Griesbach, III, Clarkston, GA (US); Linda G. Harris, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 240 days.

This patent is subject to a terminal disclaimer.

(21) Appl. No.: 10/253,103

(22) Filed: Sep. 24, 2002

(65) Prior Publication Data

US 2004/0055078 A1 Mar. 25, 2004

(51) Int. Cl.[7] ..... A62B 18/02; A42B 1/18
(52) U.S. Cl. ..... 128/206.12; 128/206.19
(58) Field of Search ..... 2/206, 9; 128/206.25, 128/863, 857, 206.27, 206.19, 206.14, 206.12, 205.27, 205.29, 206.13, 206.16, 206.17, 206.21, 206.24, 206.28, 207.11

(56) References Cited

U.S. PATENT DOCUMENTS

| | | | | |
|---|---|---|---|---|
| 1,317,947 A | * | 10/1919 | Soderling | 128/206.17 |
| 2,079,582 A | * | 5/1937 | Whipple | 128/206.24 |
| 2,112,960 A | | 4/1938 | Harvey | |
| 2,290,885 A | | 7/1942 | Lehmberg | |
| 2,317,608 A | * | 4/1943 | Heidbrink | 128/206.24 |
| 2,378,929 A | * | 6/1945 | Joyce | 128/206.15 |
| 2,391,565 A | * | 12/1945 | Grindrod et al. | 128/205.25 |
| 2,391,677 A | * | 12/1945 | Bulbulian | 128/201.19 |
| 2,921,581 A | | 1/1960 | Swearingen et al. | |
| 2,928,387 A | * | 3/1960 | Layne | 128/201.19 |
| 3,038,470 A | | 6/1962 | Campbell | |
| 3,220,409 A | | 11/1965 | Liloia et al. | |

(Continued)

FOREIGN PATENT DOCUMENTS

| | | |
|---|---|---|
| EP | 758009 | 3/1999 |
| WO | WO 89/01902 | 3/1989 |
| WO | 98/54991 | 12/1998 |
| WO | 99/61089 | 12/1999 |
| WO | 00/69497 | 11/2000 |
| WO | 02/49467 | 6/2002 |

OTHER PUBLICATIONS

*American Society for Testing and Materials*, ASTM Designation: D 2979–88, "Standard Test Method for Pressure–Sensitive Tack of Adhesives Using an Inverted Probe Machine", Oct. 1988, pp. 194–196.

* cited by examiner

*Primary Examiner*—Rodney M. Lindsey
(74) *Attorney, Agent, or Firm*—Scott B. Garrison; Dana E. Stano

(57) ABSTRACT

A face mask is disclosed. The face mask includes an inside surface, an outside surface having at least one edge, and at least one loop having a first end and a second end attached to the outside surface, where the loop is less than about 80 millimeters in length.

50 Claims, 5 Drawing Sheets

U.S. PATENT DOCUMENTS 3,308,816 A 3/1967 Franklin et al.
3,338,992 A 8/1967 Kinney
3,341,394 A 9/1967 Kinney
3,502,763 A 3/1970 Hartman
3,542,615 A 11/1970 Dobo et al.
3,602,913 A 9/1971 Neese
3,692,618 A 9/1972 Dorschner et al.
3,768,100 A 10/1973 Colman et al.
3,802,817 A 4/1974 Matsuki et al.
3,849,241 A 11/1974 Butin et al.
3,881,632 A 5/1975 Early et al.
3,953,566 A 4/1976 Gore
4,014,616 A 3/1977 Mast, Jr. et al.
4,041,203 A 8/1977 Brock et al.
4,167,185 A * 9/1979 Lewis ..... 128/206.24
4,187,390 A 2/1980 Gore
4,215,682 A 8/1980 Kubik et al.
4,269,315 A 5/1981 Boyce
4,296,746 A 10/1981 Mason, Jr. et al.
4,340,563 A 7/1982 Appel et al.
4,354,489 A 10/1982 Riaboy
4,374,888 A 2/1983 Bornslaeger
4,375,718 A 3/1983 Wadsworth et al.
4,454,881 A 6/1984 Huber et al.
4,467,799 A 8/1984 Steinberg
4,550,856 A 11/1985 Ballmann et al.
4,592,815 A 6/1986 Nakao
4,643,182 A 2/1987 Klein
4,657,010 A * 4/1987 Wright ..... 128/205.25
4,688,566 A 8/1987 Boyce
4,726,365 A 2/1988 Jablonski
4,807,619 A * 2/1989 Dyrud et al. ..... 128/206.16
4,817,636 A 4/1989 Woods
4,856,535 A 8/1989 Forbes
4,873,972 A 10/1989 Magidson et al.
4,874,659 A 10/1989 Ando et al.
4,945,574 A * 8/1990 Dagher ..... 2/9
4,951,664 A 8/1990 Niemeyer
4,969,473 A 11/1990 Bothwell
5,012,952 A 5/1991 Franz
5,014,878 A 5/1991 Janz
5,033,115 A 7/1991 Bowling et al.
5,067,633 A 11/1991 Grosz et al.
5,145,727 A 9/1992 Potts et al.
5,156,911 A 10/1992 Stewart
5,169,706 A 12/1992 Collier, IV et al.
5,178,931 A 1/1993 Perkins et al.
5,188,885 A 2/1993 Timmons et al.
5,201,869 A 4/1993 Roethel
5,237,986 A 8/1993 Seppala et al.
5,374,458 A 12/1994 Burgio
5,387,450 A 2/1995 Stewart
5,401,446 A 3/1995 Tsai et al.
5,414,867 A 5/1995 Bowling et al.
5,419,318 A 5/1995 Tayebi
5,538,013 A 7/1996 Brannon
5,561,863 A 10/1996 Carlson, II
5,618,281 A 4/1997 Betrabet et al.
5,640,974 A 6/1997 Miller
5,658,270 A 8/1997 Lichstein
5,682,879 A 11/1997 Bowers
5,690,121 A 11/1997 Miller
5,724,964 A 3/1998 Brunson et al.
5,753,343 A 5/1998 Braun et al.
5,803,077 A 9/1998 Gazzara
5,819,731 A 10/1998 Dyrud et al.
5,865,196 A 2/1999 Foote
5,883,026 A 3/1999 Reader et al.
5,918,598 A 7/1999 Belfer et al.
5,934,275 A 8/1999 Gazzara
5,954,055 A 9/1999 Miyake
6,055,982 A 5/2000 Brunson et al.
6,070,580 A 6/2000 McDonald et al.
6,095,143 A 8/2000 Dyrud et al.
6,098,201 A 8/2000 Boros, Sr.
6,102,040 A 8/2000 Tayebi et al.
6,135,988 A 10/2000 Turner et al.
6,148,817 A 11/2000 Bryant et al.
6,196,223 B1 3/2001 Belfer et al.
6,308,330 B1 10/2001 Hollander et al.
6,341,606 B1 * 1/2002 Bordewick et al. .... 128/206.25
6,394,090 B1 5/2002 Chen et al.
6,401,716 B1 6/2002 Sword et al.

EASY GRIPPING FACE MASK

BACKGROUND OF THE INVENTION

Disposable face masks have been manufactured for many years. In the medical field, early masks were designed to protect patients from pathogens contained in the exhaled air of health care personnel. In recent years, it has likewise become important to protect the health care personnel from airborne pathogens emitted by patients.

During surgical procedures, health care personnel are often required to enter and exit sterile environments to obtain equipment, supplies, and so forth. Upon entry into an examination or surgical area, the health care worker dons a face mask for protection of himself and of the patient. However, face masks that are currently available require use of both hands to be properly donned. As a result, the worker may have to either place the supplies or equipment on a surface to properly don the mask, or may have to simply hold the mask in position while transporting the supplies.

There is currently a need for a face mask that is easy to don so that proper mask usage is encouraged. More particularly, a need exists for a face mask that may be donned with a single hand so the sterility of the examination or surgical environment is not compromised.

SUMMARY OF THE INVENTION

The present invention is generally directed to a face mask sized to fit over the nose and mouth of a wearer and easy to grip with a single hand for donning.

The present relates to a face mask including an inside surface, an outside surface, and a loop having a first end and a second end, each attached to the outside surface, where the loop has a length of less than about 80 millimeters. The first end and the second end may be attached at a substantially central location on the outside surface.

The present invention further relates to a face mask including an inside surface, an outside surface having an upper edge, a lower edge, a first side edge, and a second side edge. The mask further includes a loop having a first end attached to the outside surface proximal to the first side edge, a second end attached to the outside surface proximal to the second side edge, and a fold in the loop disposed between the first end and the second end. The fold may be substantially equidistant from the first end and the second end of the loop.

The present invention further relates to a face mask having an inside surface, an outside surface defined by an edge, and a loop having a first end and a second end, each attached to the outside surface proximal to the edge, where the first end is remotely located with respect to the second end and the loop spans at least a portion of the outside surface. The loop may also include a fold disposed between the first end and the second end.

The present invention also relates to a face mask including an inside surface, an outside surface having an upper edge, a lower edge, a first side edge, and a second side edge. The mask further includes a loop having a first end attached to the outside surface proximal to the first side edge, a second end attached to the outside surface proximal to the second side edge, and an intermediate point disposed between the first end and the second end. The intermediate point may be affixed to the outside surface between the first side edge and the second side edge. The intermediate point may be removably affixed to the outside surface, and may be substantially equidistant from the first end and second end.

The present invention finally relates to a face mask including an inside surface, an outside surface having an upper edge, a lower edge, a first side edge, and a second side edge. The mask also includes a first loop and a second loop, each having a first end, a second end, and a length measured between the first end and the second end. The first loop and the second loop may be disposed on the outside surface so that a wearer can grasp the first loop and the second loop with a single hand.

In one embodiment, the first loop may be attached proximal to the first side edge, the first end and the second end of the first loop having a first loop attachment distance, and the second loop may be attached to proximal to the second side edge, the first end and the second end of the second loop having a second loop attachment distance. Where the first loop has a length greater than the first loop attachment distance, and the second loop has a length greater than the second loop attachment distance, the first loop may oppose the second loop in a symmetrical curvilinear relation on the outside surface when the mask is not donned. The first loop may include a first intermediate point disposed between the first end and the second end and, and the second loop may include a second intermediate point disposed between the first end and the second end. The first intermediate point may be affixed to the outside surface. Likewise, the second intermediate point may be affixed to the outside surface.

In another embodiment, the first end and the second end of the first loop may be attached proximal to the upper edge and the first end and the second end of the second loop may be attached proximal to the lower edge, such that the first loop and the second loop extend in a direction from the first side edge to the second side edge. In yet another embodiment, the first end and the second end of the first loop may be attached proximal to the first side edge and the first end and the second end of the second loop may be attached proximal to the second side edge, such that the first loop and the second loop extend in a direction from the upper edge to the lower edge.

DESCRIPTION OF THE INVENTION

Figure 1:
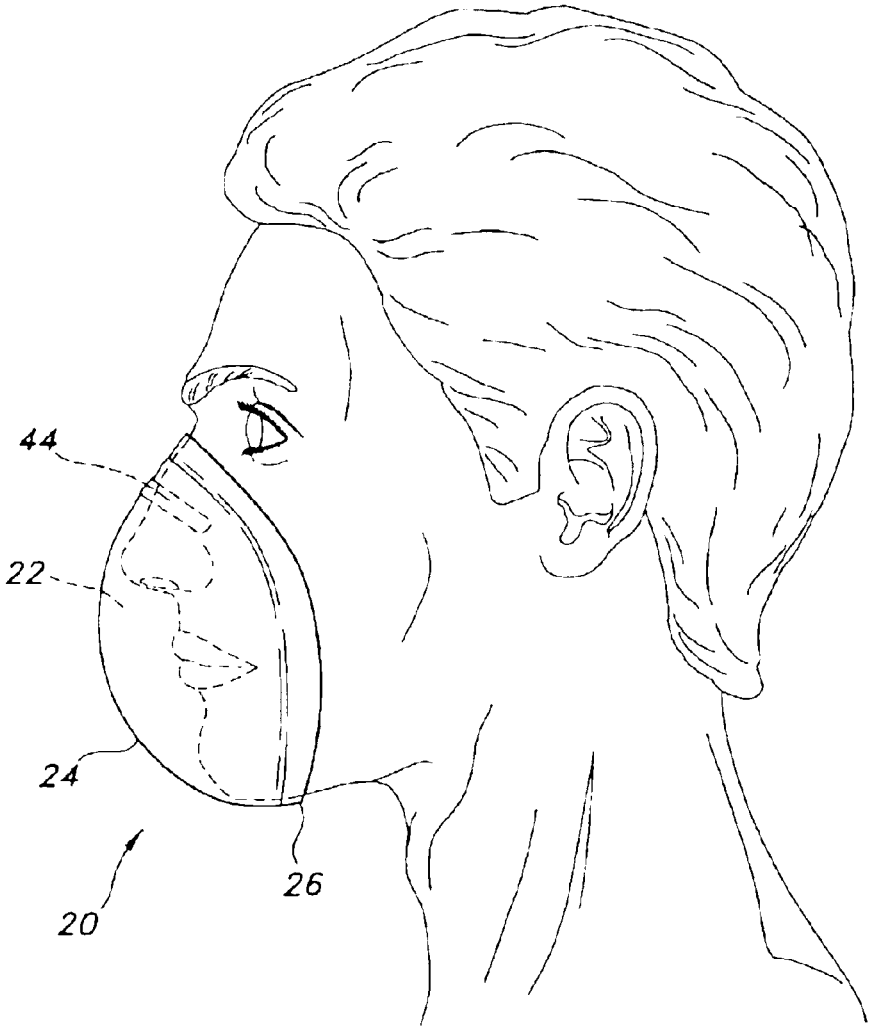
FIG. 1 is a side plan view of an exemplary cup shaped face mask donned by a wearer.

The present invention relates to a face mask that is designed to be gripped with a single hand. One embodiment of a face mask 20 is illustrated in FIG. 1. However, it should be understood that other embodiments are encompassed by the present invention.

The face mask 20 is generally sized to fit over the nose and mouth of a wearer, and includes an inside surface 22, i.e., the surface proximal to the face of the wearer, and an outside surface 24, i.e., the surface distal to the face of the wearer. The inside surface 22 includes a periphery 26 that is adapted to engage the face of the wearer when the mask is donned. The periphery 26 is generally a flange, and may be folded as in FIGS. 4 and 5, flared as in FIGS. 3, 6, and 7, or any other configuration (not shown), provided that the contact area with the face of the wearer is sufficient.

Figure 2:
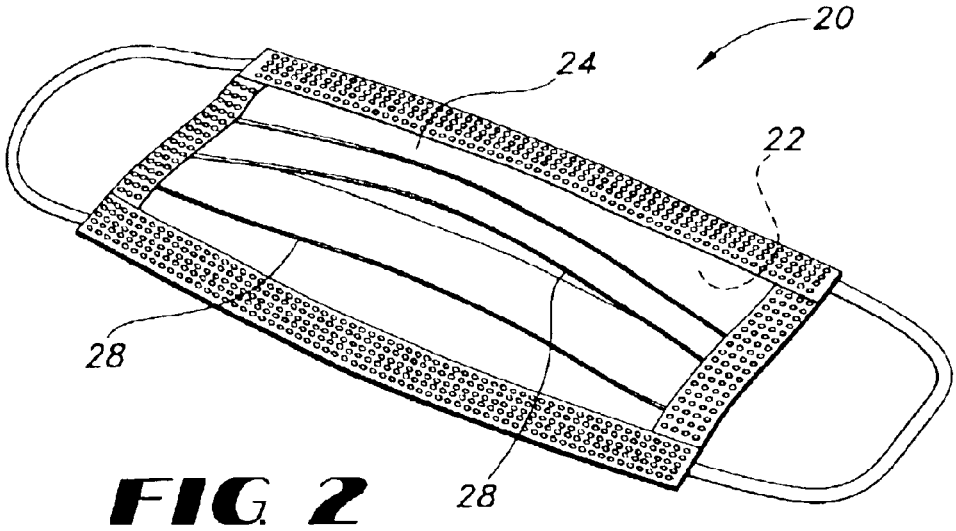
FIG. 2 is a perspective view of a rectangular pleated face mask in a partially open configuration.

The present invention relates to any style or configuration of shaped face mask that is sufficiently rigid so that the mask may be gripped with a single hand without crushing or collapsing. As used herein, the term "shaped" means having a resilient structure that is able to retain its form and dimension. Thus, a shaped face mask may be dispensed and donned without crushing or collapsing. While sufficient rigidity is required for handling, the mask must also be somewhat flexible so that the periphery of the mask is able to substantially conform to the contours of the wearer's face. In some embodiments, the mask may be cup shaped as in FIGS. 1, 3, 4, and 6–10. In other embodiments, the mask may be cone shaped (not shown). Alternatively, the mask 20 may have a rectangular shape (FIG. 2) with pleats 28, provided that the mask 20 is packaged (not shown) in at least a partially opened or expanded configuration (FIG. 2) so that the wearer can grasp the mask 20 with a hand and apply it directly to the face without having to manually expand the pleats 28. Various techniques may be used to increase the rigidity of the mask. In some embodiments, the mask may be thermally molded or heat set to increase stiffness. In other embodiments, binder chemicals may be added to the materials prior to formation of the mask.

Figure 3:
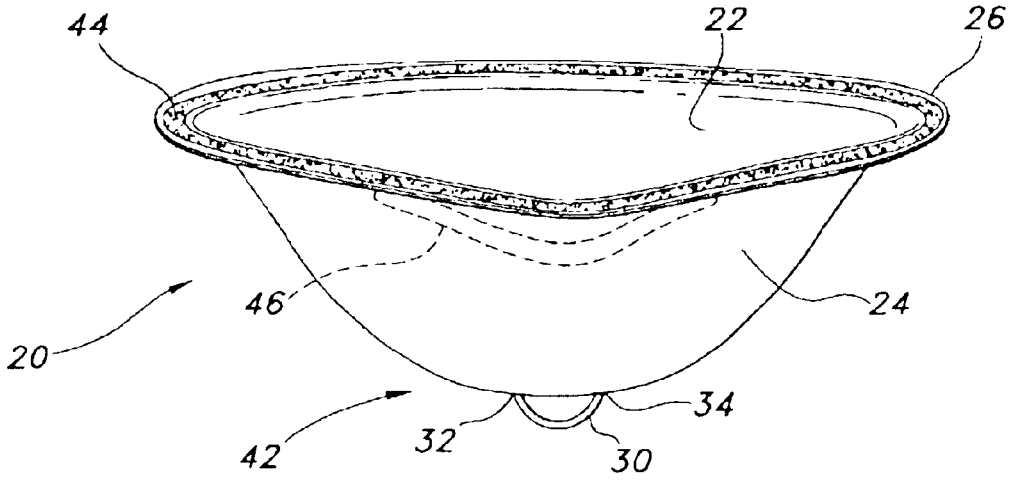
FIG. 3 is a perspective view of a cup shaped face mask having a flared edge periphery and a loop positioned so that the mask can be gripped with a single hand.
Figure 4:
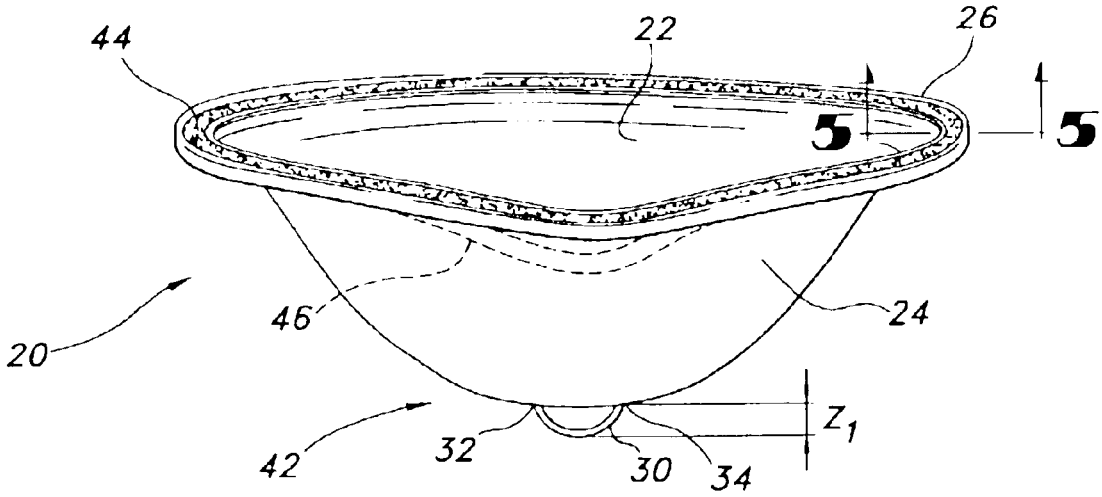
FIG. 4 is a perspective view of a cup shaped face mask having a folded edge periphery and a loop positioned so that the mask can be gripped with a single hand.
Figure 5:
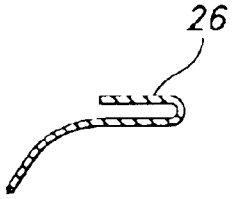
FIG. 5 is a broken-away side plan view of the folded edge periphery of the mask depicted in FIG. 4 taken along a line 5—5.

To facilitate gripping, the mask 20 of the present invention may include at least one loop 30 having a first end 32 and a second end 34, each attached to the outside surface 24. The loop 30 may be located at any point on the outside surface 24 of the mask 20. In some embodiments, the loop 30 may be positioned in a substantially central region 42 on the outside surface 24 as depicted in FIGS. 3 and 4. Such a point is generally distal to each point along the periphery 26. In this configuration, the loop 30 is positioned so that when the loop 30 is gripped, the mass of the mask 20 is substantially balanced in the wearer's hand, thereby stabilizing the mask 20 for donning.

The loop may be formed from any suitable material, such as an elastic material (e.g. a polymer), inelastic material, a nonwoven, knit, ribbon, cloth, wire, and so forth. As used herein, the term "elastic" refers to the ability of a material to recover its size and shape after deformation. As used herein, the term "inelastic" refers to the inability of a material to recover its size and shape after deformation. In some embodiments, the loop is formed from the same material selected to form the outside surface of the mask. The loop may be bonded or otherwise affixed to the outside surface. Examples of suitable techniques include adhesive bonding, thermal bonding, stitching, and so forth. As used herein, the term "adhesive" refers to the property of any material that allows the material to bond together substrates by surface attachment.

The loop 30 is generally sized and positioned to facilitate gripping by a wearer, both prior to, during, and after donning. The loop 30 may be less than about 80 mm (0.08 m) in length as measured from the first end 32 to the second end 34 along the length of the loop. In other embodiments, the loop 30 may be less than about 60 mm (0.06 m) in length. In yet other embodiments, the loop 30 may be less than about 40 mm (0.04 m) in length. Where, in some embodiments, the loop is formed from an elastic material, the loop may have a fully extended length of 200 mm (0.200 m).

The loop 30 generally extends outwardly from the outside surface 24 a sufficient distance Z1 (FIG. 4) so that the wearer of the mask 20 may grip the loop 30 between two or more fingers of a single hand. In some embodiments, the loop 30 may extend outwardly from the outside surface 24 at least 5 mm (0.005 m). In other embodiments, the loop 30 may extend outwardly from the outside surface 24 at least about 8 mm (0.008 m). In yet other embodiments, the loop may extend outwardly from the outside surface 24 at least about 10 mm (0.010 m).

Figure 6:
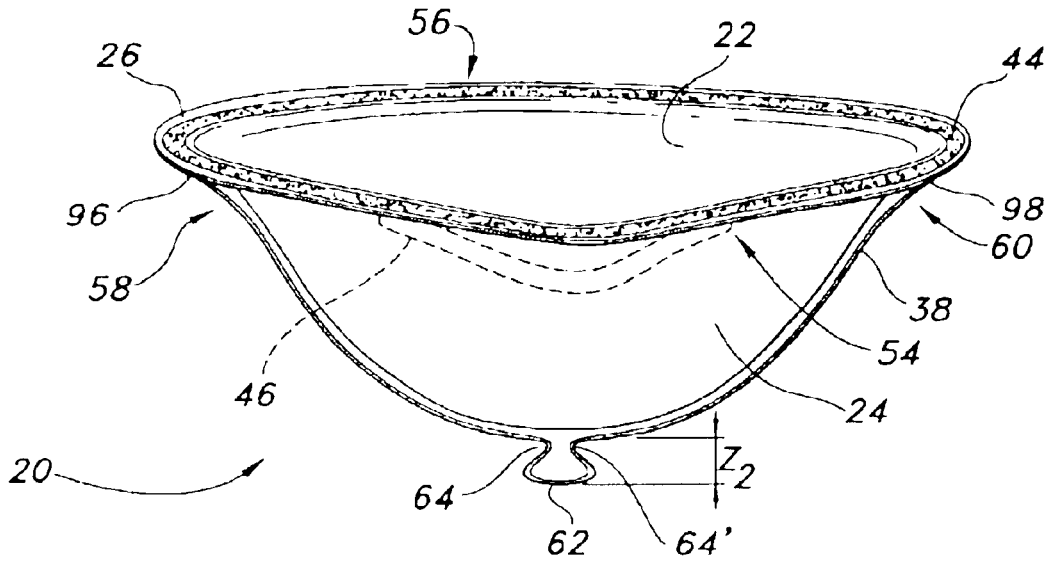
FIG. 6 is a perspective view of a cup shaped face mask having a loop with a fold positioned so that the mask can be gripped with a single hand.
Figure 7:
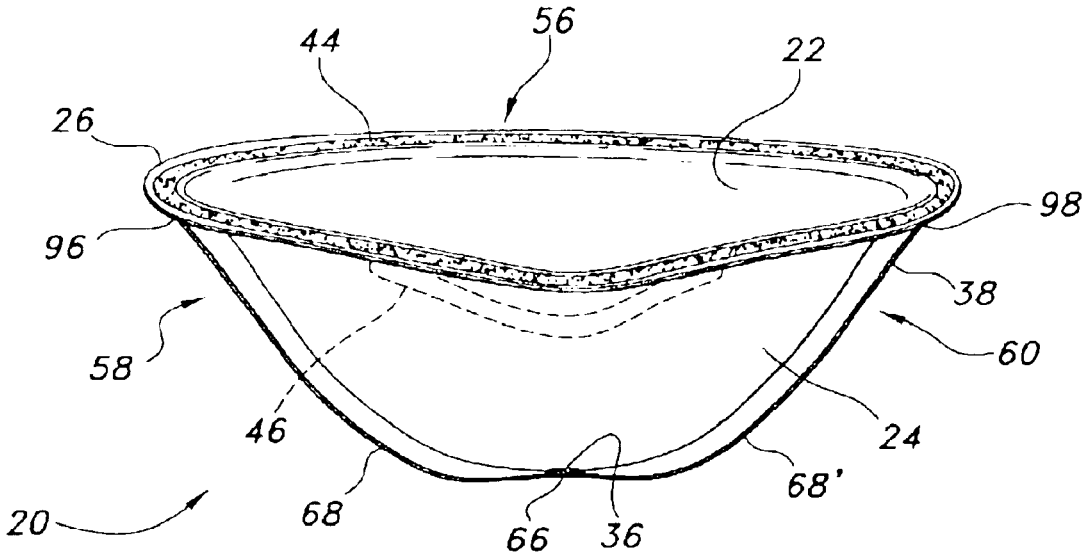
FIG. 7 is a perspective view of a cup shaped face mask having a loop with an intermediate point attached to the outside surface so that the mask can be gripped with a single hand.

In other embodiments depicted in FIGS. 6 and 7, the face mask of the present invention includes an outside surface 24 having an upper edge 54, a lower edge 56, a first side edge 58, and a second side edge 60. The upper edge 54 generally defines a region of the mask 20 that when donned follows the contours of the human face over the nose and along the upper portion of the cheeks to either side. The lower edge 56 generally defines a region of the mask 20 that when donned follows the contours of the human face along the chin and lower portion of the cheeks to either side. The first side edge 58 and second side edge 60 generally define the regions of the mask 20 that when donned extend from the nose portion to the chin portion along the cheek portions on each side. It should be understood, however, that each edge as defined is contiguous to its respective adjacent edges so that all of the edges combined form a single border around the circumference or perimeter of the mask.

The mask 20 further includes a loop 38 having a first end 32 and a second end 34. The first end 32 and the second end 34 are attached to the outside surface 24 so that the loop 38 extends in a direction from the first side edge 58 to the second side edge 60. In some embodiments, the loop 38 may span the entire width of the outside surface 24 from the first side edge 58 to the second side edge 60 and may be substantially horizontal when donned. In some embodiments, the loop 38 may be disposed substantially equidistant from the upper edge 54 and the lower edge 56.

The loop may be formed from any suitable material, such as an elastic material (e.g. a polymer), inelastic material, a nonwoven, knit, ribbon, cloth, wire, and so forth. In some embodiments, the loop is formed from the same material selected to form the outside surface of the mask. The loop may be bonded or otherwise affixed to the outside surface. Examples of suitable techniques include adhesive bonding, thermal bonding, stitching, and so forth.

In some embodiments, the loop may also be used as a securing means. In such embodiments, the loop is extended around the back of the wearer's head, thereby securing the mask to the face of the wearer.

In one embodiment depicted in FIG. 6, the loop 38 may include a fold 62 disposed between the first end 32 and the second end 34 to facilitate gripping. The fold 62 in the loop 38 enables the wearer to grip the mask more easily, thereby facilitating donning and removal of the mask 20. The fold 62 may be located at any point along the length of the loop 38. In some embodiments, the fold 62 is disposed substantially equidistant from the first end 32 and the second end 34. In such an embodiment, the mass of the mask is substantially balanced to stabilize the mask in the hand of the wearer during donning.

The fold 62 in the loop 38 is generally sized and positioned to facilitate gripping by a wearer, both prior to, during, and after donning. The fold 62 generally includes at least two creases 64 and 64' in the loop so that the fold 62 extends outward from the outside surface 24. The fold 62 may be less than about 30 mm (0.030 m) in length as measured along the length of the loop 38 between the creases 64 and 64'. In other embodiments, the fold 62 may be less than about 20 mm (0.020 m) in length. In yet other embodiments, the fold 62 may be less than about 15 mm (0.015 m) in length.

The fold 62 generally extends outwardly from the outside surface 24 a sufficient distance Z2 so that the wearer of the mask 20 may grip the fold 62 between two or more fingers of a single hand. In some embodiments, the fold 62 may extend outwardly from the outside surface 24 at least about 10 mm (0.010 m). In other embodiments, the fold 62 may extend outwardly from the outside surface 24 at least about 8 mm (0.008 m). In yet other embodiments, the fold 62 may extend outwardly from the outside surface 24 at least about 5 mm (0.005 m).

The creases 64 and 64' may be formed by any suitable technique, including thermal setting, thermal bonding, adhesive bonding or stiffening, wires, chemical additives, and so forth. The loop may be formed from a material to enhance crease formation and gripping, and in some embodiments, may be flat and wide or ribbon-like.

In another embodiment illustrated in FIG. 7, the loop 38 may include an intermediate point 66 disposed the first end 32 and the second end 34. The intermediate point 66 may be affixed to the outside surface 24 between the first side edge 58 and the second side edge 60. The intermediate point 66 divides the loop 38 into two segments 68 and 68' that may be gripped individually or simultaneously by the wearer to facilitate donning of the mask 20. In some embodiments, the intermediate point 66 may be substantially equidistant from the first end 32 and the second end 34, thereby substantially balancing the mass of the mask 20 in the wearer's hand. The intermediate point 66 may be removably affixed to the outside surface. In some embodiments, the intermediate point 66 may be removably affixed to the outside surface 24 by a bead 36 of an adhesive material. Such an adhesive material used for this purpose may have a sufficiently low adhesion strength so that when the loop is detached from the adhesive material, the efficacy of the mask is not compromised.

Figure 9:
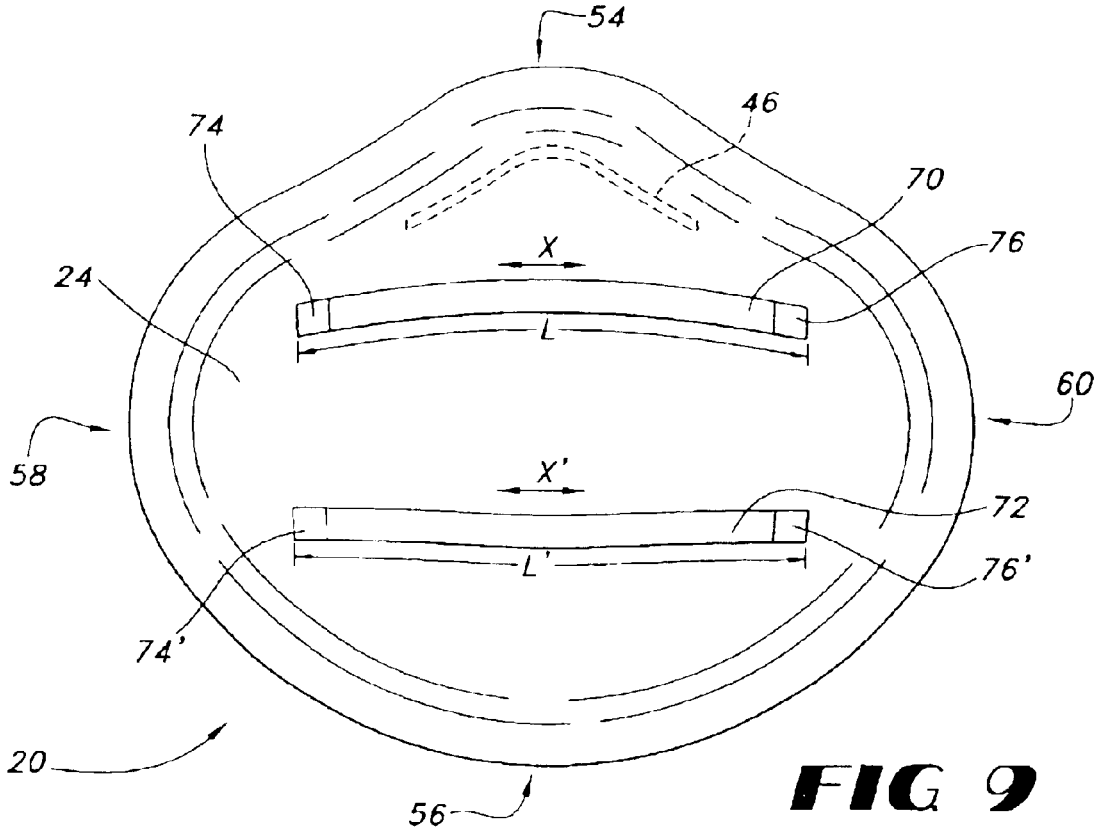
FIG. 9 is a top plan view of a cup shaped face mask having a first loop and a second loop, each extending from a first side edge to a second side edge of the outside surface and spaced so that the first loop and the second loop can be gripped with a single hand.
Figure 10:
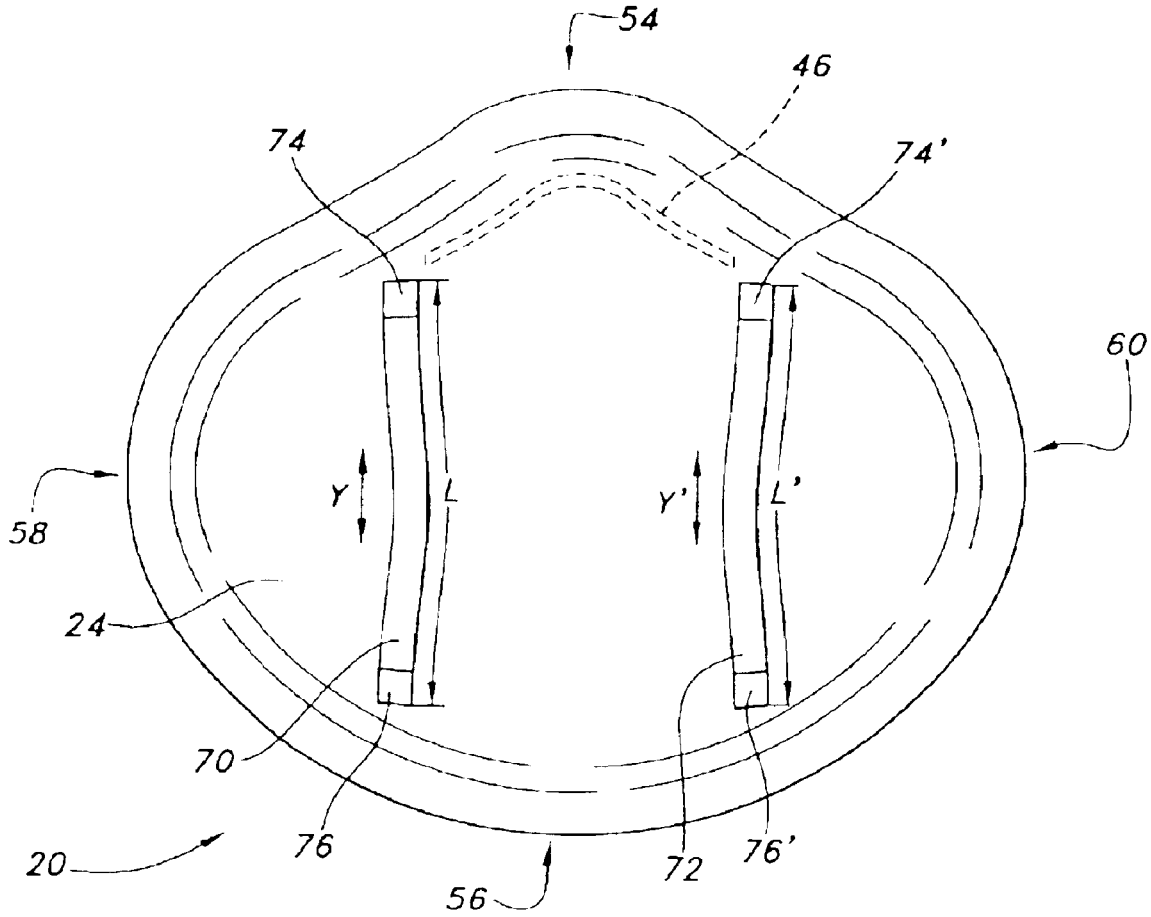
FIG. 10 is a top plan view of a cup shaped face mask having a first loop and a second loop, each extending from an upper edge to a lower edge of the outside surface and spaced so that the first loop and the second loop can be gripped with a single hand.

FIGS. 9, 10, and 11 depict other masks made according to the present invention. Such masks include at least a first loop 70 and a second loop 72 disposed on the outside surface 24. The first loop 70 and the second loop 72 are spaced so that a wearer can grip the first loop 70 and the second loop 72 with a single hand. Each loop 70 and 72 includes a first end 74 and 74', a second end 76 and 76', and a length L and L' measured between the first end 74 or 74' and its respective second end 76 or 76'.

The first loop and the second loop may be formed from any suitable material, such as an elastic material (e.g. a polymer), inelastic material, a nonwoven, knit, ribbon, cloth, wire, and so forth. In some embodiments, the loop is formed from the same material selected to form the outside surface of the mask. The loop may be bonded or otherwise affixed to the outside surface. Examples of suitable techniques include adhesive bonding, thermal bonding, stitching, and so forth. Further, the first loop and the second loop may be configured in a variety of manners, including those described below.

Figure 8:
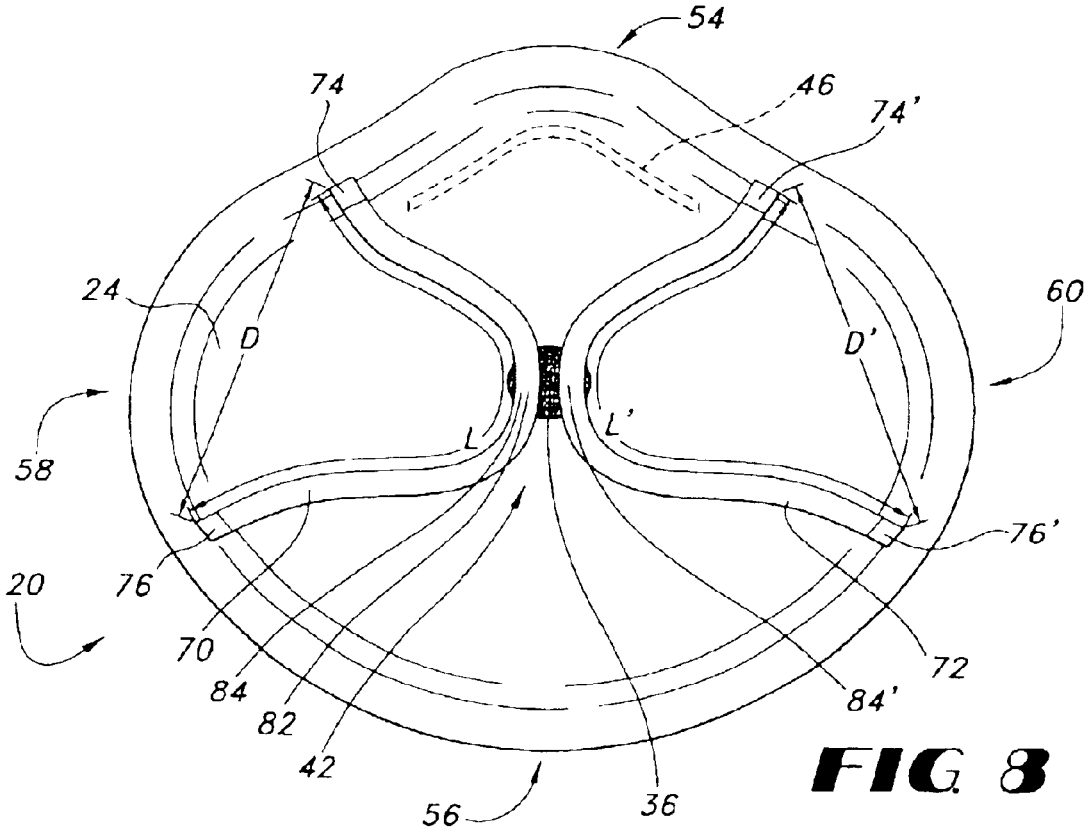
FIG. 8 is a top plan view of a cup shaped face mask having a first loop and a second loop attached to the mask, where each loop has an intermediate point removably affixed to the outside surface.

In one embodiment depicted in FIG. 8, the first end 74 and the second end 76 of first loop 70 are attached proximal to the first side edge 58. The length L of the first loop 70 may be sufficient in magnitude, so that, when attached to the outside surface 24, the length L is greater than the attachment distance D. As used herein, "attachment distance" means the distance between the first end and second end of the loop as measured directly on the outside surface of the mask. Where the length L is greater than the attachment distance D, the unattached portion of the loop 70 may tend to lie flat on the outside surface 24 of the mask 20, forming a curvilinear shape. Such shape may be parabolic, and in some instances, the vertex 82 of the parabola lies near the central region 42 of the outside surface 24. Where the second loop 72 likewise has a length L' greater than its attachment distance D', the first loop 70 may oppose the second loop 72 in a symmetrical curvilinear relation on the outside surface 24.

In some embodiments, the first loop 70 may include an first intermediate point 84 between the first end 74 and the second end 76. The first intermediate point 84 may be affixed to the outside surface 24 between the first side edge 58 and the second side edge 60. In some embodiments, the second loop 72 may include a second intermediate point 84' between the first end 74' and the second end 76'. The second intermediate point 84' may be affixed to the outside surface 24 between the first side edge 58 and the second side edge 60. The first intermediate point 84 may be substantially equidistant from the first end 74 and the second end 76 of the first loop 70 and may form the vertex 82 of the parabolic shape described above. Likewise, the second intermediate point 84' may be substantially equidistant from the first end 74' and the second end 76' of the second loop 72. In some embodiments, the first intermediate point 84 and/or the second intermediate point 84' are removably affixed to the outside surface 24.

Various means of removably affixing the first intermediate point 84 and the second intermediate point 84' may be used, including for example, a bead 36 of an adhesive material (FIG. 7), an adhesive tape (not shown), and so forth. In some embodiments, the first loop and the second loop may be used as ear loops to secure the mask to the face of the wearer (not shown). In such an embodiment, after the mask is gripped and brought into contact with the face of the wearer the wearer may detach the intermediate points from the outside surface and don the ear loops.

In another embodiment depicted in FIG. 9, the first end 74 and the second end 76 of the first loop 70 are attached proximal to the upper edge 54 and the first end 74' and the second end 76' of the second loop 72 are attached proximal to the lower edge 56, such that the first loop 70 and the second loop 72 extend in a direction X and X' from the first side edge 58 to the second side edge 60. Alternatively, in another embodiment depicted in FIG. 10, the first end 74 and the second end 76 of the first loop 70 are attached proximal to the first side edge 58 and the first end 74' and the second end 76' of the second loop 72 are attached proximal to the second side edge 60, such that the first loop 70 and the second loop 72 extend in a direction Y and Y' from the upper edge 54 to the lower edge 56. The first loop and second loop are spaced so that a wearer can grip the first loop and the second loop to facilitate donning. The first loop may be parallel to the second loop on the outside surface. Other loop configurations are contemplated by the present invention, including additional loops, overlapping loops, and so forth.

The above-described features are designed to enable the wearer to grip the mask with a single hand, usually between the thumb and one or more fingers. The wearer is then able to bring the mask into contact with his or her face so that the periphery is positioned in a comfortable location. In some embodiments, an adhesive material 44 may be applied to the periphery 26 (FIGS. 3, 4, 6, and 7) to enhance comfort, fit, efficacy, and so forth. In such embodiments, the mask may be donned with a single hand, thereby providing a significant advantage over many commercially available masks that require use of two hands to properly position the mask on the wearer's face and secure the mask to the wearer's face. Any adhesive material used must be suitable for application to the skin.

Certain polysiloxane adhesives are believed suitable for use with the present invention. One such adhesive material is described in U.S. Pat. No. 5,618,281 to Betrabet et al., incorporated herein by reference in its entirety. Other suitable adhesive materials include those described in U.S. Pat. No. 5,658,270 to Lichstein, incorporated herein by reference in its entirety. However, it is contemplated that other suitable pressure-sensitive adhesive materials known in the art may be used with the present invention.

Alternatively, a temperature-sensitive adhesive material that is substantially nontacky at or below about 25° C. that becomes tacky upon contact with skin may be used. As used herein, the term "substantially nontacky" refers to a substance that exhibits a tack of less than about 5 g/cm$^2$ of force as measured by ASTM D2979. As used herein, the term "tacky" refers to a substance that exhibits a tack of at least about 10 g/cm$^2$ of force as measured by ASTM D2979. In this test, the tack value is expressed as grams of force required to remove the end of a stainless steel rod 5.0 mm in diameter from the surface of an adhesive material coating at a speed of 10 mm per second to which it has been adhered for 1.0 second. Suitable adhesive materials have a narrow melting transition range to ensure a rapid change from a substantially nontacky state to a tacky state. By way of example only, suitable temperature-sensitive adhesive materials are provided by U.S. Pat. No. 5,156,911 to Stewart, incorporated herein by reference in its entirety. However, it is contemplated that other suitable temperature-sensitive adhesive materials known to those of skill in the art may be used with the present invention.

The face mask may also incorporate any combination of known features, such as visors or shields, beard covers, etc. (not shown). Ear loops may also be attached to the mask proximal to the periphery so that if the medical personnel is required to remain in the sterile environment for an extended period of time, the worker is able to don the ear loops to further secure the mask to the face (not shown). The mask 20 may also include an elongated malleable member 46 (FIGS. 1, 3, 4, 6–10) disposed proximal to at least a portion of the periphery 26 for configuring the mask 20 to closely fit the contours of the nose and cheeks of the wearer. The malleable member 46 may be made of any malleable material including, but not limited to, metal wire or an aluminum band.

The face mask of the present invention may be formed from a variety of materials and fabrics, such as woven reusable fabrics and nonwoven disposable fabrics or webs. As used herein, the term "nonwoven fabric" or "nonwoven web" or "nonwoven material" means a web having a structure of individual fibers or threads that are randomly interlaid, but not in an identifiable manner or pattern as in a knitted fabric. Nonwoven fabrics or webs have been formed from many processes, for example, meltblowing processes, spunbonding processes, and bonded carded web processes.

As used herein, the term "spunbond" or "spunbond fibers" or "spunbonded fibers" refers to small diameter fibers that are formed by extruding molten thermoplastic material as filaments from a plurality of fine, usually circular capillaries of a spinneret with the diameter of the extruded filaments then being rapidly reduced, for example, as in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al.

As used herein, the term "meltblown" or "meltblown fibers" means fibers formed by extruding a molten thermoplastic material through a plurality of fine, usually circular, die capillaries as molten threads or filaments into converging high velocity, usually hot, gas (e.g. air) streams that attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al.

The face mask may be formed from a single layer of material or a composite of multiple layers. In the case of multiple layers, the layers are generally positioned in a juxtaposed or surface-to-surface relationship and all or a portion of the layers may be bound to adjacent layers. The multiple layers of a composite may be joined to form a multilayer laminate by various methods, including but not limited to adhesive bonding, thermal bonding, or ultrasonic bonding. One composite material suitable for use with the present invention is a spunbond/meltblown/spunbond (SMS) laminate. An SMS laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Multilayer laminates may have multiple meltblown layers or multiple spunbond layers in many different configurations and may include materials other than nonwovens. Examples of such other materials include wovens, films, foam/film laminates and combinations thereof, for example, a spunbond/film/spunbond (SFS) laminate. Examples of other composite materials suitable for use in the present invention include, but are not limited to, those described in U.S. Pat. No. 4,041,203 to Brock et al., U.S. Pat. No. 5,169,706 to Collier, et al., U.S. Pat. No. 5,145,727 to Potts et al., U.S. Pat. No. 5,178,931 to Perkins et al., U.S. Pat. No. 4,374,888 to Bornslaeqer, and U.S. Pat. No. 5,188,885 to Timmons et al., which are all incorporated herein by reference.

The face mask of the present invention may include a layer of material, for example, a nonwoven material, suitable for filtration. The filtration material may be made from a meltblown nonwoven web and, in some embodiments, may be subject to electret treating. As used herein, the term "electret" or "electret treating" refers to a treatment that imparts a charge to a dielectric material, such as a polyolefin. The charge includes layers of positive or negative charges trapped at or near the surface of the polymer, or charge clouds stored in the bulk of the polymer. The charge also includes polarization charges that are frozen in alignment of the dipoles of the molecules. Methods of subjecting a material to electret treating are well known by those skilled in the art. These methods include, for example, thermal, liquid-contact, electron beam, and corona discharge methods. One particular technique of subjecting a material to electret treating is disclosed in U.S. Pat. No. 5,401,466, the contents of which are herein incorporated in its entirety by reference. This technique involves subjecting a material to a pair of electrical fields wherein the electrical fields have opposite polarities. Electret treatment results in a charge being applied to the filtration medium that further increases filtration efficiency by drawing particles to be filtered toward the filter by virtue of their electrical charge. Electret treatment can be carried out by a number of different techniques. One technique is described in U.S. Pat. No. 5,401,446 to Tsai et al. assigned to the University of Tennessee Research Corporation and incorporated herein by reference in its entirety. Other methods of electret treatment are known in the art, such as that described in U.S. Pat. No. 4,215,682 to Kubik et al., U.S. Pat. No. 4,375,718 to Wadsworth, U.S. Pat. No. 4,592,815 to Nakao and U.S. Pat. No. 4,874,659 to Ando, incorporated herein by reference in their entirety.

Alternatively, the mask may include a layer of expanded polytetrafluoroethylene (PTFE) membrane for filtration, such as those manufactured by W. L. Gore & Associates. A more complete description of the construction and operation of such materials can be found in U.S. Pat. No. 3,953,566 to Gore and U.S. Pat. No. 4,187,390 to Gore, incorporated herein by reference in their entirety.

The minimum filtration efficiency requirements differ for various applications. The filtration efficiency of the face mask may be expressed in terms of its sodium chloride (NaCl) efficiency. The NaCl efficiency measures the ability of a fabric or web to prevent the passage of small particles (about 0.1 micron) through it. A higher efficiency is generally more desirable and indicates a greater ability to remove particles. The NaCl efficiency may be measured by an automated filter tester. One such apparatus is available from TSI, Inc., P.O. Box 64394, 500 Cardigan Rd, St. Paul, Minn. 55164, designated as the Model 8110 Automated Filter Tester (AFT). The Model 8110 AFT measures pressure differential and particle filtration characteristics for air filtration media. The AFT utilizes a compressed air nebulizer to generate a submicron aerosol of sodium chloride particles that serve as the challenge aerosol for measuring filter performance. The characteristic size of the particles used in these measurements is 0.1 micron. Typical air flow rates are between 31 liters per minute and 33 liters per minute. The AFT test is performed on a sample area of about 140 $cm^2$. The performance or efficiency of a filter medium is expressed as the percentage of sodium chloride particles that penetrate the filter, penetration being defined as transmission of a particle through the filter medium. The transmitted particles are detected downstream from the filter using a light scattering technique. The percent penetration (% P) reflects the ratio of the downstream particle count to the upstream particle count. In some embodiments, the mask may have a NaCl efficiency above 80 percent. In some other embodiments, the mask may have a higher filtration efficiency, for example, from about 95 percent to about 99.997 percent. In some embodiments, the maximum pressure differential through the mask may be less than 5 millimeters of water (mm H2O).

Where present, the filtration layer may also be required to attain a desired bacterial filtration efficiency (BFE). The BFE is a measure of the ability of a material to prevent the passage of bacteria through it. Face masks for medical applications may require a BFE of greater than or equal to about 96%. BFE may be measured according to military specification MIL-M-36954C, 4.4.1.1.1 and 4.4.1.2. The BFE is expressed as a percentage with a maximum efficiency of 100%. The BFE of a material may be measured, for instance, by Nelson Laboratories of Salt Lake City, Utah.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A face mask comprising:

an inside surface;

an outside surface; and a loop having a first end and a second end, each attached to the outside surface, wherein the loop has a length of less than about 80 millimeters and is substantially horizontal when donned by a wearer.

2. The mask of claim 1, the loop having a length of less than about 60 millimeters.

3. The mask of claim 1, the loop having a length of less than about 40 millimeters.

4. The mask of claim 1, wherein the first end and the second end are attached at a substantially central location on the outside surface.

5. The mask of claim 1, the loop extending outwardly from the outside surface at least 5 millimeters.

6. The mask of claim 1, the loop extending outwardly from the outside surface at least about 8 millimeters.

7. The mask of claim 1, the loop extending outwardly from the outside surface at least about 10 millimeters.

8. The mask of claim 1, wherein the loop is formed from an elastic material.

9. The mask of claim 1, wherein the loop is formed from an inelastic material.

10. The mask of claim 1, the inside surface comprising a periphery having an adhesive material disposed on at least a portion thereof.

11. A face mask comprising:

an inside surface;

an outside surface having an upper edge, a lower edge, a first side edge, and a second side edge; and a loop used to secure the mask to the head of a wearer having a first end attached to the outside surface proximal to the first side edge, a second end attached to the outside surface proximal to the second side edge, and a fold in the loop disposed between the first end and the second end.

12. The mask of claim 11, wherein the loop is substantially equidistant from the upper edge and the lower edge.

13. The mask of claim 11, wherein the fold is substantially equidistant from the first end and the second end.

14. The mask of claim 11, the fold having a length of less than about 30 millimeters.

15. The mask of claim 11, the fold having a length of less than about 20 millimeters.

16. The mask of claim 11, the fold having a length of less than about 15 millimeters.

17. The mask of claim 11, the fold extending outwardly from the outside surface at least 5 millimeters.

18. The mask of claim 11, the fold extending outwardly from the outside surface at least about 8 millimeters.

19. The mask of claim 11, the fold extending outwardly from the outside surface at least about 10 millimeters.

20. The mask of claim 11, wherein the loop is formed from an elastic material.

21. The mask of claim 11, wherein the loop is formed from an inelastic material.

22. The mask of claim 11, wherein the loop is a ribbon.

23. The mask of claim 11, the inside surface comprising a periphery having an adhesive material disposed on at least a portion thereof.

24. A face mask comprising:

an inside surface;

an outside surface defined by an edge; and a loop having a first end and a second end, each attached to the outside surface proximal to the edge so that the loop is substantially horizontal when donned by a wearer, wherein the first end is remotely located with respect to the second end and the loop spans at least a portion of the outside surface, and a fold in the loop disposed between the first end and the second end.

25. The mask of claim 24, wherein the fold is disposed in a substantially central location on the outside surface.

26. The mask of claim 24, wherein the fold extends outwardly from the outside surface at least 5 millimeters.

27. A face mask comprising:

an inside surface;

an outside surface having an upper edge, a lower edge, a first side edge, and a second side edge; and a loop having a first end attached to the outside surface proximal to the first side edge, a second end attached to the outside surface proximal to the second side edge, and an intermediate point between the first end and the second end, the intermediate point being removably affixed to the outside surface between the first side edge and the second side edge.

28. The mask of claim 27, wherein the loop is disposed substantially equidistant from the upper edge and the lower edge.

29. The mask of claim 27, wherein the intermediate point is removably affixed by an adhesive material.

30. The mask of claim 27, wherein the intermediate point is substantially equidistant from the first end and second end.

31. The mask of claim 27, wherein the loop is formed from an elastic material.

32. The mask of claim 27, the inside surface comprising a periphery having an adhesive material disposed on at least a portion thereof.

33. The mask of claim 27, wherein the loop is used to secure the mask to the head of a wearer.

34. A face mask comprising:

an inside surface;

an outside surface having an upper edge, a lower edge, a first side edge, and a second side edge; and a first loop and a second loop, each having a first end, a second end, and a length measured between the first end and the second end, the first loop and the second loop attached to the outside surface such that a wearer can grasp the first loop and the second loop with a single hand, the first loop having a first intermediate point between the first end and the second end, and the second loop having a second intermediate point between the first end and the second end, the first intermediate point and the second intermediate point being affixed to the outside surface.

35. The mask of claim 34, the first loop being attached proximal to the first side edge, the first end and the second end of the first loop having a first loop attachment distance, and the second loop being attached proximal to the second side edge, the first end and the second end of the second loop having a second loop attachment distance, wherein the first loop has a length greater than the first loop attachment distance, and the second loop has a length greater than the second loop attachment distance, such that when the mask is not donned, the first loop opposes the second loop in a curvilinear relation on the outside surface.

36. The mask of claim 34, wherein the first intermediate point and the second intermediate point are removably affixed.

37. The mask of claim 34, the first intermediate point and the second intermediate point being removably affixed to the outside surface by an adhesive material.

38. The mask of claim 34, wherein the first intermediate point is substantially equidistant from the first end and the second end of the first loop, and the second intermediate point is substantially equidistant from the first end and the second end of the second loop.

39. The mask of claim 34, wherein the first loop and the second loop are ear loops.

40. The mask of claim 34, wherein the first end and the second end of the first loop are attached proximal to the upper edge and the first end and the second end of the second loop are attached proximal to the lower edge, such that the first loop and the second loop extend in a direction from the first side edge to the second side edge.

41. The mask of claim 34, wherein the first end and the second end of the first loop are attached proximal to the first side edge and the first end and the second end of the second loop are attached proximal to the second side edge, such that the first loop and the second loop extend in a direction from the upper edge to the lower edge.

42. The mask of claim 34, the inside surface comprising a periphery having an adhesive material disposed on at least a portion thereof.

43. The mask of claim 34, wherein the mask is cup shaped.

44. A face mask comprising:

an inside surface;

an outside surface having an upper edge, a lower edge, a first side edge, and a second side edge; and a loop used to secure the mask to the head of a wearer having a first end attached to the outside surface proximal to the first side edge, a second end attached to the outside surface proximal to the second side edge, and an intermediate point between the first end and the second end, the intermediate point being affixed to the outside surface between the first side edge and the second side edge.

45. The mask of claim 44, wherein the loop is disposed substantially equidistant from the upper edge and the lower edge.

46. The mask of claim 44, wherein the intermediate point is removably affixed.

47. The mask of claim 46, the intermediate point as removably affixed by an adhesive material.

48. The mask of claim 44, wherein the intermediate point is substantially equidistant from the first end and second end.

49. The mask of claim 44, wherein the loop is formed from an elastic material.

50. The mask of claim 44, the inside surface comprising a periphery having an adhesive material disposed on at least a portion thereof.

* * * * *